United States Patent [19]

Mason

[11] 4,177,408

[45] Dec. 4, 1979

[54] COMBINED SWITCH AND FLASHER

[76] Inventor: Robert D. Mason, 5501 Mick Ave., Kentwood, Mich. 49508

[21] Appl. No.: 802,883

[22] Filed: Jun. 2, 1977

[51] Int. Cl.[2] ..... H05B 37/02; H05B 39/06; H05B 41/04; H05B 41/18

[52] U.S. Cl. ..... 315/362; 200/6 R

[58] Field of Search ..... 200/5 R, 6 R; 307/112, 307/132 R, 132 V; 315/136, 362, 200 A; 340/331, 332

[56] References Cited

U.S. PATENT DOCUMENTS

| | | | |
|---|---|---|---|
| 2,695,403 | 11/1954 | Stoker et al. | 340/331 X |
| 3,047,773 | 7/1962 | Morton | 340/331 X |
| 3,058,032 | 10/1962 | Woodward | 315/272 |
| 3,631,318 | 12/1971 | Hubbard | 340/331 X |
| 4,003,040 | 1/1977 | Browand | 340/332 |
| 4,038,582 | 7/1977 | Horwinski | 315/136 X |

*Primary Examiner*—Alfred E. Smith
*Assistant Examiner*—Robert E. Wise
*Attorney, Agent, or Firm*—H. Dale Palmatier

[57] ABSTRACT

A switching apparatus to be substituted in a conventional wiring system of a building for the on-off switch of a conventional light such as a porch light for causing the light to flash on and off, the switching apparatus including a flasher wafer which is switched into and out of the circuit for the light and which flasher wafer is confined in an open and unobstructed pocket within the switch housing so as to be readily inserted and removed for replacement, the switch toggle being translucent and illuminated in synchronism with the flashing produced by the flasher wafer.

9 Claims, 11 Drawing Figures

ON
FLASH
OFF

COMBINED SWITCH AND FLASHER

This invention relates to a combined switch and flasher for a particular light, such as a porch light, which is a part of the existing wiring system of a house or other building.

BACKGROUND OF THE INVENTION

No apparatus is known to replace the conventional on-off light switch for a porch light in order to allow the light to be operated conventionally and to also be operated intermittently as by flasher.

It is extremely valuable to have a light such as a porch light with the capability of flashing on and off repeatedly so as to attract attention for one reason or another. For instance, a person may want to attract the attention of an emergency vehicle, such as a police car or fire engine, which has been contacted by telephone. Also, a feeble person or invalid may find it highly desirable to use an outdoor flashing light to attract the attention of neighbors or friends who may be concerned for such a person.

Of course, more frequent usage may be made of such a flasher to merely attract the attention of guests who are expected to arrive in the evening. Oftentimes there are numerous porch lights turned on in a neighborhood so that the flashing light will attract attention so as to make a particular location more apparent.

Previous attempts have been made to provide for the flashing of a porch light, as in U.S. Pat. No. 3,058,032. According to this patent, it was required to run an extra wire between the switch and the light socket, and of course this therefore entails a major rewiring job, necessitating hiring an electrician at a considerable expense. Such people as may need a flashing porch light are usually those who are least able to pay the cost of hiring an electrician to wire in a new circuit as described in the patent. Also, the patent describes and illustrates the use of a separate flasher unit which must be connected by wires into the circuit for the porch light. The flasher is merely located, as an extra component, in an enclosed location in the switch box.

SUMMARY OF THE INVENTION

According to the present invention, a switching apparatus is provided to effectively replace a conventional on-off switch for a porch light, for the purpose of incorporating a flasher which may be alternately switched into and out of the light circuit, as well as permitting the light to be turned on and off in a conventional manner. The switching apparatus may be substituted for a conventional switch in a true sense, and the two wires in the outlet box which are normally connected to the on-off switch may be also connected to the flasher-producing switching apparatus in a conventional manner. As soon as this connection is made, the flasher unit is entirely operational without requiring any rewiring.

The switching apparatus incorporates a replaceable flasher wafer or disc within its housing. The flasher wafer which has contacts at the centers of its opposite faces, engages one of the connector terminals of the switch at one face and engages one of the switch contacts at the other face to be switched into and out of the light circuit. The flasher may be readily replaced by simply removing the cover of the switch body and lifting the flasher wafer out of a pocket in the housing. The switch handle or toggle may be translucent, and an internal light may be provided in the switch so as to illuminate the switch toggle each time the porch light is illuminated.

DETAILED SPECIFICATION

Figures 1, 2, 3, 4, 5, 6, 7, 8, 9, 10, 11:
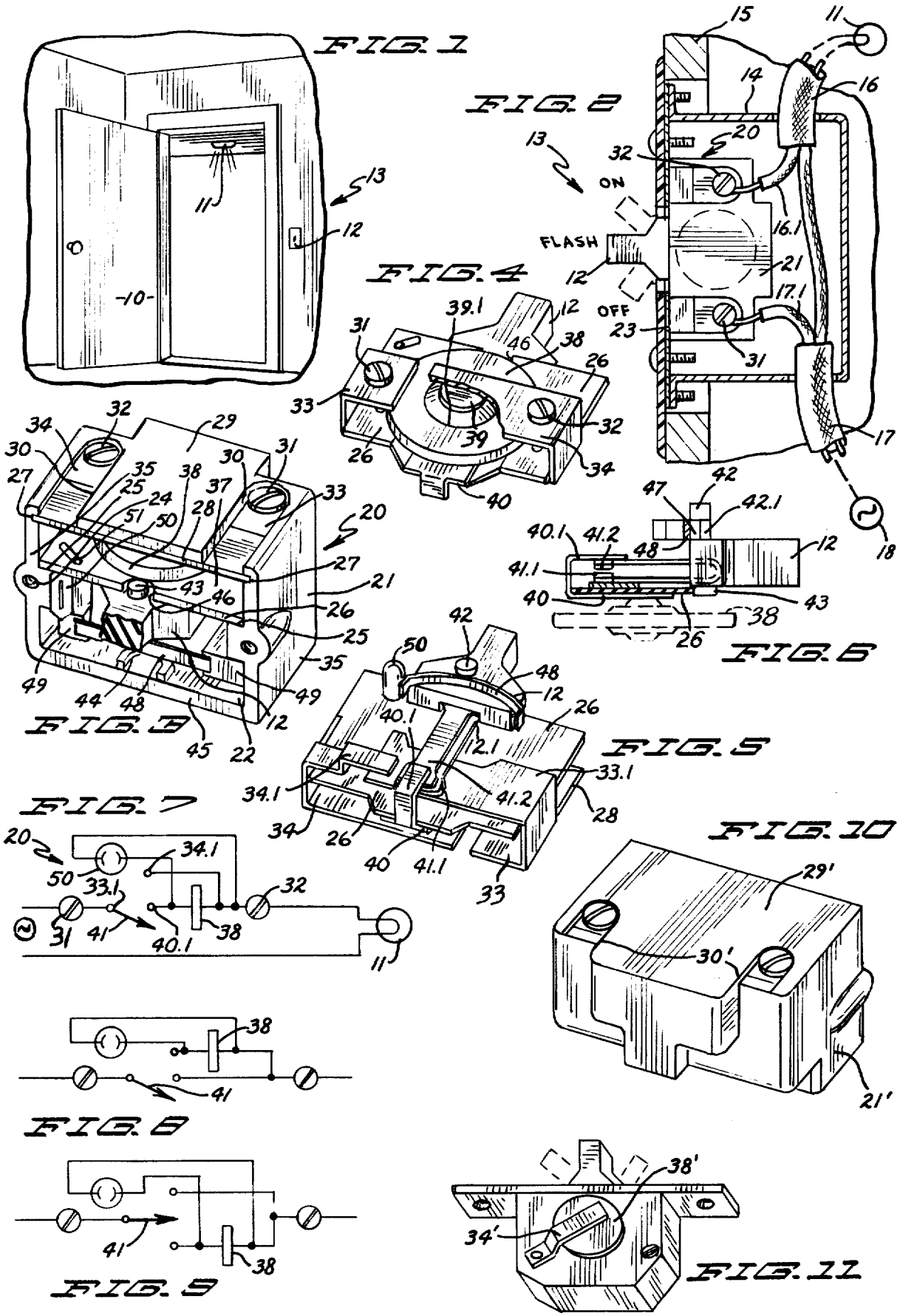
FIG. 1 is a perspective view of a doorway illustrating the switching apparatus in place and the flashing porch light.
FIG. 2 is a detail section view through the wall mounted switch box and showing the switching apparatus incorporated therein.
FIG. 3 is a perspective view illustrating the switch apparatus with its front cover removed.
FIG. 4 is a perspective view of the apparatus within the switch housing.
FIG. 5 is another view of the switch apparatus in inverted position.
FIG. 6 is a detail end elevation view of the toggle and the wipers and one switch contact.
FIG. 7 is a schematic circuit diagram illustrating the connections in the switch apparatus and to the porch light.
FIGS. 8 and 9 are alternative schematic circuit arrangements.
FIG. 10 is a perspective view of a modified form of the housing.
FIG. 11 is a perspective view of an alternative embodiment of the invention.

In FIG. 1, the door 10 is ajar so that the porch light 11 can be seen to be flashing while the switch toggle or handle 12 of the switch mechanism indicated in general by numeral 13 is in its center or flashing position. The toggle 12 may be swung downwardly in the usual manner to turn the porch light off, or otherwise may be swung upwardly to its normal up position to turn the porch light on for continuous illumination in the usual manner.

The switch mechanism is also shown in general in FIG. 2 wherein the outlet box 14 is shown in its stationary position relative to the building wall 15 and is connected by a two-wire cable 16 to the porch light 11, and the two-wire cable 17 extending to a source of power 18 in the usual manner. It will be understood that it is contemplated that the box 14 and the cables 16 and 17 and the light 11 are all existing equipment already in place. The switch apparatus 20 inserted into the switch box 14 simply connects to the two wires 17.1 and 16.1 already in the box and normally used to simply turn the porch light 11 on and off.

The switch apparatus 20 has a housing or body 21 having an open side 22 over which a steel strap or cover 23 lies and is secured by screws threaded into holes 24 in the end walls of the housing 21. The housing 21 has transversely oriented shoulder surfaces 25 against which an insulating base panel 26 lies. A pair of grooves 27 in the end walls confine the ends of an insulating hold-down panel 28.

One sidewall 29 of the housing has a pair of wide slots 30 therein adjacent the opposite ends for receiving the terminal screws 31 and 32 to which the wires 17.1 and 16.1 are respectively connected. Terminal screws 31 and 32 are respectively threaded into brass terminal plates 33 and 34, respectively, which are held against the bottom of the housing by the insulated panel 28. Both of the terminal plates 33 and 34 are bent in a substantially sharply angular U-shaped configuration and the end edges thereof are maintained in spaced apart relation. The terminal plates 33 and 34 also bear against the shoulder surfaces 25 at the end walls of the housing, and the terminal plates 33 and 34 are held against the end walls 35 and 36 of the housing by the insulating panel 26.

There is an open and unobstructed space defining a pocket 37 between the panel 26 and panel 28, and the pocket 37 extends entirely from the open side 22 of the housing of the bottom thereof. The pocket 37 contains a circular flasher wafer or disc 38. Such a flasher wafer or disc is a staple article of trade, and is available in many stores handling electrical goods; one such wafer is known as a socket button flasher, sold under the trademark SNAP IT, Catalog No. 22685 (12685 of Cable Products, Inc., Providence, R.I. 02907). The flasher wafer has exposed electrical contacts 39 at the opposite faces thereof and centrally located, and the remainder of the entire periphery of the wafer 38 is covered by an insulating plastic sheath 39.1. One contact 39 of the flasher wafer bears against the contact plate 34 adjacent the housing sidewall 29, and the other contact of the flasher wafer bears against another terminal plate 40 which lies against the insulating base panel 26.

The terminal plate 40 is also U-shaped and is held downwardly against the bottom of the housing by the lower edge of the insulating panel 26.

The switching function is accomplished by wiper contacts 41.1 and 41.2 which are in one piece and integral of each other and which are affixed to the translucent plastic toggle or handle 12 of the switch apparatus. The wiper contact 41.1 is in continuous engagement with terminal contact 33.1 which is integral with the terminal plate 33 and which lies along and in flush engagement with the rear side of the insulating panel 26. As illustrated in FIG. 5, the wiper contact 41.1 is engageable with a terminal contact 40.1 which is integral with the terminal plate 40 and which is in spaced and confronting relation with the terminal contact 33.1, allowing the wiper contacts 41.1 and 41.2 to slide therebetween while engaging both of the terminal contacts. The wiper contacts 41.1 and 41.2 are swingable away from the terminal contact 40.1 as illustrated in FIG. 5 and along the terminal contact 33.1 in a counterclockwise direction so that the wiper contact 41.2 will not be engaging any other contact in the assembly. In this situation, the switch presents an open circuit between the terminal screws 31 and 32.

Terminal contact 34.1 is also located in spaced and confronting relation with an end portion of the terminal contact 33.1 and in spaced relation with the insulating panel 26 as to receive the wiper contacts 41.1 and 41.2 in the space between and engaged simultaneously with both of the terminal contacts 33.1 and 34.1. This switch position is achieved by swinging the wiper contacts 41.1 and 41.2 in a slightly clockwise direction from that position illustrated in FIG. 5. In this position of the wiper contacts, the continuous circuit continuity is achieved between the terminal screws 31 and 32 so as to turn the porch light to a continuing on position.

With the wiper contacts 41.1 and 41.2 in the center position as illustrated in FIG. 5, the flasher wafer is switched into the circuit, as follows: A circuit is established from the terminal screw 32 through the terminal plate 34 to the contact 39 of the flasher 38; the contact at the opposite face of the flasher 38 bears against and establishes a circuit at the terminal plate 40, and the terminal contact 40.1 engages the wiper contact 41.2 which is common with the wiper contact 41.1; and the contact 41.1 engages and establishes a circuit with the terminal contact 33.1 of terminal plate 33 into which the terminal screw 31 is threaded. Accordingly, an intermittent flashing of the light is produced.

The wiper contacts 41.1 and 41.2, being of a common piece of metal, are retained in a slot 12.1 of the toggle to be affixed in stationary relation with respect to the toggle. The wiper contacts 41.1 and 41.2 are of spring material and are biased away from each other so as to bear firmly against the terminal contacts which they engage.

The toggle 12 is provided with pivot bearings 42 and 43 which are cylindrically shaped and which are rotatably supported in a bearing notch 44 in the sidewall 45 of the housing, and in another bearing notch 46 in the insulated panel 26. The pivot bearing 43 terminates substantially flush with panel 26 so as not to protrude into or across the open entrance to the pocket 37 in which the flasher wafer 38 is confined.

The pivot bearing 42 is part of a pin 42.1 which is formed integrally of and in one piece with the translucent toggle 12, and the pin 42.1 has a plurality of flat surfaces 47 confronting a leaf spring 48 and oriented at oblique angles with respect to each other so that the three flat surfaces 47 will sequentially and individually lie flush against the leaf spring 48 to hold the toggle in the three principal positions thereof. The leaf spring 48 is supported upon ledges 49 which are formed integrally with the housing 21 adjacent the rear wall 45 thereof.

The pivot bearings 42 are captured in the notch bearings 44 and 46 and retained therein by the rigid cover strap 23 which entirely closes the open side of the housing. Of course, the cover strap 23 has a rectangular aperture through which the toggle 12 extends.

A neon light bulb 50 is affixed to and mounted on the insulated panel 26 immediately adjacent the translucent toggle 12 to illuminate the toggle. The electrical connections for the light 50 are through a resistor 51 so as to be connected in shunt with the flasher wafer 38. The light will accordingly be intermittently flashed as the flasher wafer is rendered intermittently conductive and non-conductive.

In FIG. 7, the circuitry of the switch apparatus 20 is illustrated together with the connections to the power source and porch light. The wiper contacts are cumulatively denominated by the numeral 41 in FIG. 7. It will be noted that the terminal screw 31 is continuously connected to the wiper contact 41 which is selectively engageable with contact 34.1 which provides a continuous circuit to the terminal screw 32 and porch light 11, or engageable with the terminal contact 40.1 which renders a complete circuit through the flasher wafer 38. The neon light 50 is seen to be connected in shunt with the flasher wafer.

The arrangement illustrated in FIG. 7 shows the porch light to be off when the toggle is in its lowermost position, on when the toggle is in its uppermost position, and flashing when the toggle is in its intermediate position.

In FIG. 8, a slightly different circuit arrangement is illustrated showing the flasher 38 to be in the circuit when the wiper contacts 41 are in their uppermost position, and showing the continuous circuit to be established when the wiper contacts are in their intermediate position, and the terminal screws are entirely disconnected when the wiper contacts are in their lowermost position.

The alternative circuit of FIG. 9 is essentially opposite to that of FIG. 8 and illustrates the wiper contacts to create an open circuit or off condition when in their intermediate position, and on or completed circuit connection to be established when the wiper contacts are in their upper position, and to connect the flasher into the circuit when the wiper contacts are in their lowermost position.

In FIG. 10, an alternative form of the housing 21' is illustrated. In this form, the terminal screw slots 30' open through the bottom of the sidewall so that the upper portion of the sidewall 29' is complete and continuous across the upper edge. In this version, the hold-down insulating panel 28 is eliminated.

In FIG. 11, a three position switch is illustrated having similar circuit contacts as illustrated in the other form of the invention, but with the flasher wafer 38' affixed on the outside of the case by a terminal plate 34'.

It will be seen that I have provided a replacement switch apparatus for the conventional on-off switch of a porch light so as to produce a flashing or intermittent illumination of the porch light without requiring any rewiring of the original circuitry of the building. The switch apparatus incorporates a flasher wafer or disc confined in an unobstructed pocket in the switch housing, and the wafer cooperates with the base panel and terminal plates in retaining all of the parts in predetermined and fixed relation with respect to each other. The flasher wafer is readily removable and replaceable simply by removal of the cover strap which also serves the purpose of retaining the pivot bearings of the switch toggle in fixed relation within the housing. A light within the switch housing illuminates the translucent toggle when the flasher is intermittently operating the remotely located porch light.

What is claimed is:

1. A switching apparatus connected to the existing two wires in a switch box, comprising a housing to be accommodated within the switch box and having an open interior and a cover plate at one side of the open interior, a base panel traversing the interior of the housing and confronting the sidewalls, a first face of the panel being spaced from the adjacent housing wall and cooperating therewith in defining an unobstructed pocket, a flasher wafer in said pocket, and having electrical connection at its opposite faces, and a mechanical switching mechanism within the housing and adjacent a second face of the base panel opposite the first face thereof and having circuit means connected in series with said flasher wafer.

2. The switching apparatus according to claim 1 and said adjacent housing wall having a pair of terminals to which such wires may be connected.

3. The switching apparatus according to claim 2 wherein the flasher wafer has opposite sides and a contact at each side, one of the terminals having means bearing against one of the flasher wafer contacts, and additional contact means adjacent the base panel and bearing against the other contact of the flasher wafer.

4. The switching apparatus according to claim 1 and the switch mechanism including a swinging toggle in the interior of the housing and confronting the second face of the base panel, the toggle having pivot pins extending transversely of the housing, the wall of the housing facing the second face of the base panel having bearing means carrying one of the pivot pins and the base panel having bearing means carrying the other of the pivot pins.

5. The switching apparatus according to claim 4 and the bearing means comprising open topped notches, and a cover on the housing and retaining the pivot pins in the notches.

6. The switching apparatus according to claim 4 and the side of said pocket being open and unobstructed immediately adjacent said bearing means in the base panel.

7. The switching apparatus according to claim 4 and said housing having a combined cover plate and mounting strap secured to the housing to enclose the open interior thereof and confine the flasher wafer in said pocket, said cover plate also retaining the pivot pins of the switch toggle in the bearing means of the housing and base panel.

8. The switching apparatus according to claim 4 and said pivot pin of the switch toggle adjacent the wall of the housing having a plurality of flat indexing faces oriented obliquely of each other and adjacent each other in tandem relation about the pivot axis, the housing having a leaf spring engaging and resiliently bearing against one of such surfaces and engageable in sequence with the other of said surfaces of the switch toggle as the toggle is turned to various positions.

9. In the wiring system for a building having an illuminating light in a public area and an existing pair of wires extending between the light and a switch box located in a private area at which the light is to be controlled, the improvement comprising a switching apparatus including a switch housing mounted in the box and having only a pair of exterior terminals respectively connected to the wires in the box, a flasher wafer enclosed within the housing and having a wafer shape with contacts at opposite faces thereof, the interior of the housing defining a pocket in which said flasher is confined, one of such terminals having conductor means engaging one of the contacts of the flasher, and switch means in the housing and including conductor means engaging the other contact of the flasher, the switch means having a toggle handle selectively movable to three positions, said switch means including a wiper attached to said toggle and moving between positions at which said terminals are selectively connected and disconnected together and at which the flasher is interposed in the circuit between the terminals to induce flashing of the illuminating light.

* * * * *